United States Patent [19]

Schall

[11] 3,990,631

[45] Nov. 9, 1976

[54] CENTRIFUGAL SCRAPER AND SEPARATOR APPARATUS

[76] Inventor: Wallace J. Schall, 1101 - 17th St. NW., Canton, Ohio 44703

[22] Filed: May 9, 1975

[21] Appl. No.: 576,180

Related U.S. Application Data

[63] Continuation-in-part of Ser. No. 520,556, Nov. 4, 1974, abandoned.

[52] U.S. Cl. ..... 233/7; 233/21; 233/46; 233/1 E

[51] Int. Cl.[2] ..... B04B 1/04; B04B 1/20

[58] Field of Search ..... 233/2, 3, 7, 27, 46, 233/21, 1 E, 1 R

[56] References Cited

UNITED STATES PATENTS

| | | | |
|---|---|---|---|
| 3,011,647 | 12/1961 | Elsken | 233/7 X |
| 3,403,848 | 10/1968 | Windsor et al. | 233/7 |
| 3,437,209 | 4/1969 | Evans | 233/2 X |

FOREIGN PATENTS OR APPLICATIONS

| | | | |
|---|---|---|---|
| 904,999 | 2/1954 | Germany | 233/7 |

*Primary Examiner*—George H. Krizmanich
*Attorney, Agent, or Firm*—Oldham & Oldham Co.

[57] ABSTRACT

A continuously operable apparatus including a rotatably positioned container having an open upper end and with a stack of annular discs in the container where the discs are of uniform inner and outer diameters for a major portion of the height of the stack but being of progressively smaller inner diameters approaching the upper end of the stack to form a conically shaped inner surface. A helical scraper means is positioned within the stack of discs and has an outer peripheral surface complementary to the inner surfaces of the stacked discs. Brake means are operatively associated with a top member that has the scraper means secured thereto to produce relative rotation of the helical scraper re the stack of discs for scraping solid particles therefrom to deliver them to the upper end of the apparatus.

10 Claims, 4 Drawing Figures

CENTRIFUGAL SCRAPER AND SEPARATOR APPARATUS

This is a continuation-in-part of my prior application Ser. No. 520,556, filed Nov. 4, 1974 now abandoned.

BACKGROUND OF INVENTION

Heretofore there have been many different types of centrifugal separator devices provided, and primarily they have been designed to throw the heavier solid particles of the solid-liquid, or a solid-air or gas mix to the outer periphery of a container that is rotated on a central axis at a high speed. Such separation action and apparatus has been satisfactory for many purposes. However, improvement of the separation action and design of centrifugal separators is required for some purposes and a low cost effective separator is desired in the art. Prior separators are represented by U.S. Pat. Nos. 1,572,299 and 1,952,788.

The general object of the present invention is to provide a novel and improved centrifugal separator characterized by a stack of discs positioned within a rotatable body and wherein the fluid in a fluid-solid mixture will flow through the stack of rotatable discs and substantially all of the solids collect on the inner surfaces of the discs in the stack.

Another object of the invention is to provide a rotatable scraper member in association with the disc type separator apparatus of the invention and to have the inner diameters of the discs in the stack of discs and a helical scraper means positioned within the discs being of complementary shapes for brushing or sliding relative movement therebetween.

Another object of the invention is to provide a centrifugal separator wherein the solids are deposited at a radially inner portion of the separator apparatus and fluids flow to the peripheral portions of the apparatus for removal therefrom.

A further object of the invention is to provide a relatively uncomplicated, low cost centrifugal separator apparatus which is characterized by the requirement of minimum maintenance thereon and which apparatus will function effectively for separating solid particles from fluid-solid mixtures.

The foregoing and other objects and advantages of the invention will be made more apparent as the specification proceeds.

When referring to corresponding members shown in the drawings and referred to in the specification, corresponding numerals are used to facilitate comparison therebetween.

SUBJECT MATTER OF INVENTION

Figure 1:
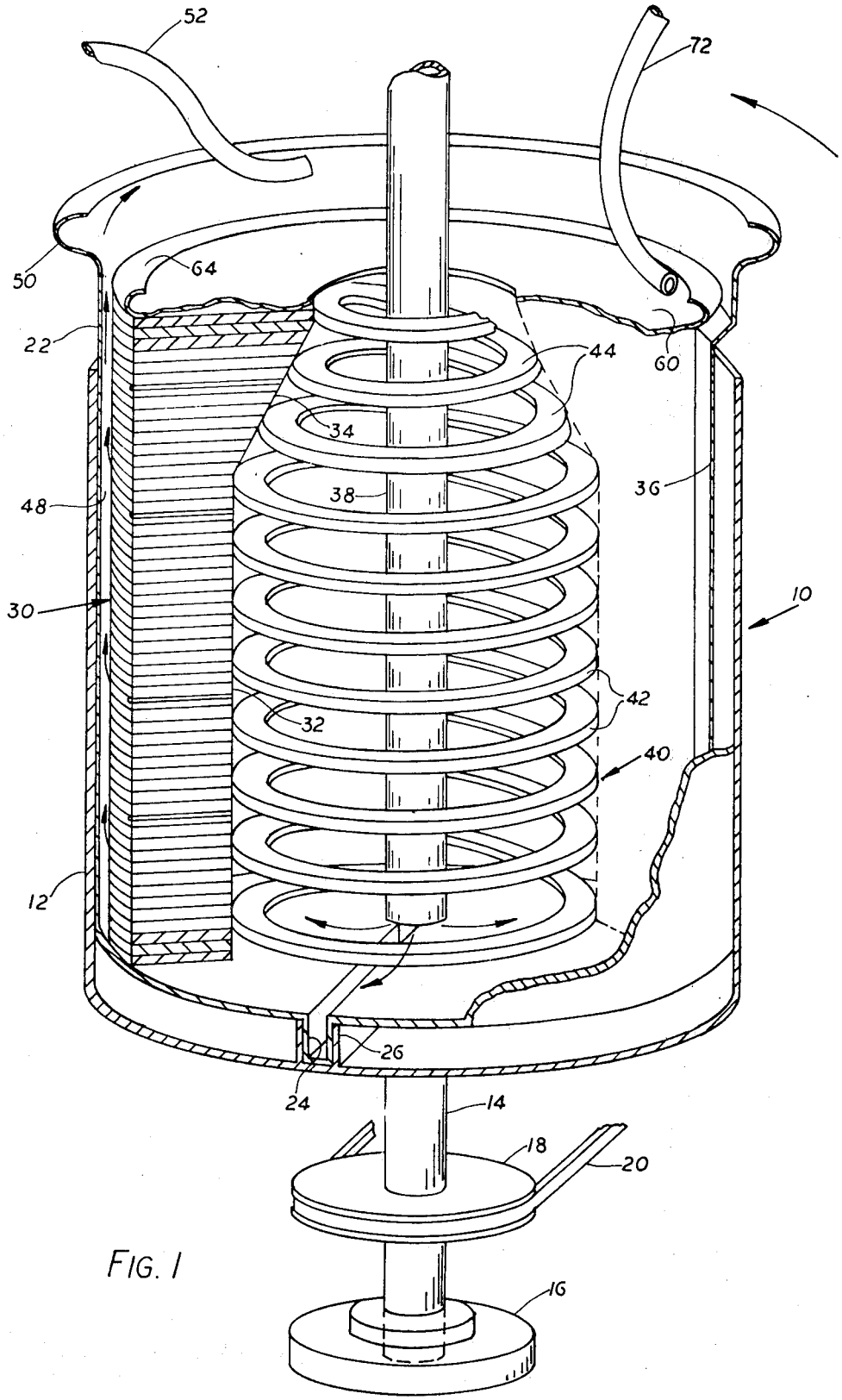
FIG. 1 is a perspective view, partially broken away and shown in vertical section, of centrifugal separating apparatus embodying the principles of the invention, but with the brake means omitted for clarity.

The centrifugal scraper and separator apparatus comprises, as one embodiment of the invention, a container having an open upper end and positioned on a vertical axis for rotation thereon, a stack of annular discs in the container, which discs are spaced from the inner wall of the container but are centrally positioned therein, the discs being of uniform inner and outer diameters for a major portion of the height of the stack but being of progressively smaller inner diameters approaching the upper end of the stack to form a conically shaped inner surface, a vertically positioned inlet tube extends into the container to the lower end thereof from above the container, a helical scraper means positioned within the stack of discs and having a cylindrical lower section and a conically shaped upper section for scraping engagement with the inner surfaces of the discs, a collector plate at the upper end of the stack of discs, a brake or means above the collector plate and having the upper end of the scraper means secured thereto, means for removing liquids or fluids flowing through the stack of discs and collected in the container, and brake means for the brake plate to engage the same to slow rotation of such plate and the scraper means with relation to the stack of said discs, whereby solids collecting on the inner peripheries of the discs of the stack of discs by fluid flowing through between the stacked discs will be progressively moved upwardly of the apparatus for deposit on the collector plate.

The centrifugal scraper and separator apparatus of the invention is indicated as a whole by the numeral 10 and it includes a container 12 having an open upper end and means mount the container on a vertical axis for rotation thereof. Such means may include a positioning shaft 14 secured to a bottom portion of the container 12, a suitable support or bearing block 16 for the lower end of the shaft 14 is also provided. A pulley 18 is secured to the shaft and has a drive belt 20 secured thereto and connecting to a suitable drive motor (not shown).

Preferably the container 12 receives an inner container 22 therein and removably carried thereby. Such inner container is engaged with the container 12 as, for example, by a plurality of interlocking ribs 24 and associated groove members 26 on the inner and outer containers whereby unitary rotation of the containers is obtained.

Figure 3:
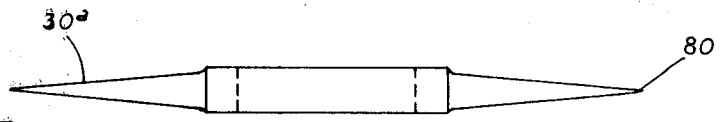
FIG. 3 is a section of a disc as could be used in the disc brake in the apparatus of FIG. 1.
Figure 4:
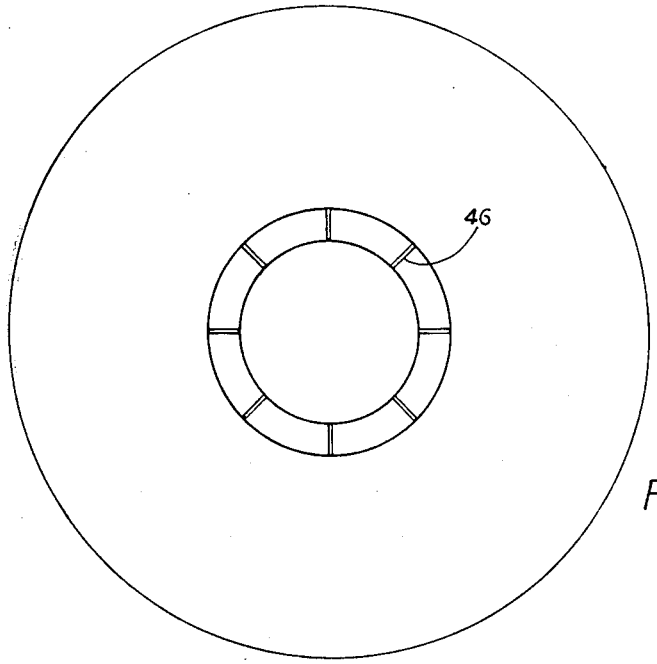
FIG. 4 is a plan view of the disc of FIG. 3.

It is a feature of the present invention that a stack of annular discs is positioned in and carried by the inner container 22. Such stack of discs 30 has a plurality of individual annular discs therein, usually just stacked on top of each other. The discs have flat top and bottom surfaces and the outer diameters of the discs preferably are uniform. The discs may be as shown in FIG. 3 and in all events the discs are not in fully abutting contact as by forming small radially extending grooves or ribs in their face surfaces for air or liquid to flow therethrough. The inner diameters of these discs 30, as indicated at 32, are of a uniform size to form a cylindrical wall on the inner surface of the stack of discs. However, as the discs approach the upper end of the stack of discs 30, the inner peripheries or walls of these discs taper inwardly at a common angle, as indicated in FIG. 1, to provide a substantially conically shaped overall surface as indicated at 34. The discs are positioned in the container 22 and spaced from the walls thereof as by a plurality of radially inwardly extending, circumferentially spaced vertical ribs 36 provided on the inner wall of this container. The ribs 36 snugly engage the discs to retain them in fixed relationship to the container during rotation of the apparatus.

The apparatus is particularly adapted for processing liquid-solid mixtures, which have solid materials suspended in or distributed through the liquid, although fluid-solid mixes may also be processed, to remove the solids therefrom. Such mixture is provided to the apparatus by an inlet pipe 38 that is suitably positioned adjacent the apparatus and extends down into the apparatus substantially to the bottom of the container 22 for controlled, usually continuous supply of the mixture to the apparatus for processing therein.

Another important feature of the present invention resides in a helical scraper means 40 that is positioned within the discs forming the stack of discs 30. Such helical scraper means has a cylindrical lower section 42 substantially horizontally aligned with the cylindrical wall portion 32 on the discs, whereas a conically shaped section of portion 44 is provided on an upper end of the scraper means. The outer peripheral surfaces of the scraper member 40 and the inner surfaces of the discs forming the stack of discs 30 are of complementary shapes and have only a small clearance for the scraper so that the scraper means is adapted to rub on or slide along such inner peripheral surfaces of the discs. The discs normally just being stacked on top of each other permit liquid or gas to be forced therethrough but preferably the discs have surface irregularities as a plurality of radially extending grooves 46 provided in one or both of the face surfaces thereof. These grooves 46 are relatively small in depth so that all but extremely small particles of any solid material in the liquid or gas mix being processed would not flow therethrough. Fluid flowing through between the discs forming the stack of discs then will flow vertically upwardly upwardly through an open space or flow path 48 formed between the outer peripheries of the discs in the stack of discs 30 and the inner wall of the container 22 to be collected in an upper collector wall or ring 50 provided on the container 22 at its upper end. A stationarily positioned fluid removal tube 52 extends down into engagement with this collector section or wall 50 to have fluid forced therein for discharge and/or to pick up, as by suction, liquid or gas flowing thereto to remove it from the apparatus. Processing of fluids is facilitated by the conical inward taper of the upper part of the disc stack as it prevents fluids from moving right up to the top and not losing their particles.

Figure 2:
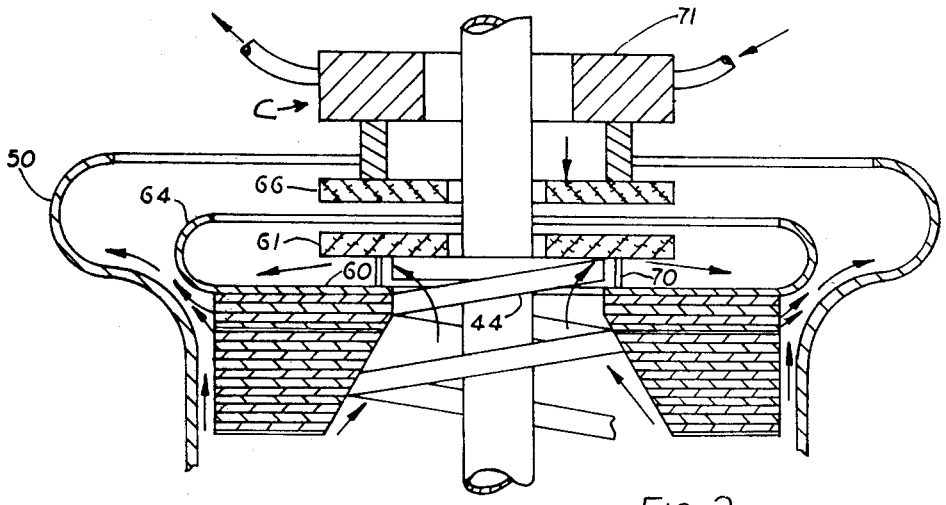
FIG. 2 is a fragmentary enlarged vertical section of the upper portion of the apparatus of FIG. 1 and showing a typical brake means.

In order to obtain good scraping action between the scraper means 40 and the stack of discs, a means is provided for slowing down the relative rotation of the scraper means so that it rotates at a different rate than the container 22 and the discs therein. FIG. 2 of the drawings best shows that the upper end of the scraper means 40 extends through a hole 59 in the plate 60 and is secured to a brake means or disc 61. This scraper means 40 normally is axially springy and is formed from a flat wire or bar bent to the shape and size as shown so that it rests on the bottom of the container 22. The upper end of this scraper wire is secured to the lower surface of the brake disc. 61. The collector disc 60 has an overhanging upper flange section 64 to collect solids deposited onto the disc by the scraper. A brake means or disc 66 is positioned above the brake disc 61. An operative member, indicated at the letter C in the drawing, such as a fixed annular cylinder, is provided and it can reciprocate the disc 66 in a vertical direction to obtain a braking action by the disc 66 on the disc 61 and the scraper means 40 secured thereto. The scraper will normally rotate with the container 22 by being supported thereon. But, when a retarding force is placed on the scraper by the brake disc, the scraper will then have sliding engagement with the container and the helical scraper will rotate at a controlled speed with relation to the stack of discs. The helical scraper means is formed to push or slide solid particles deposited on the inner edges of the discs upwardly of the apparatus and thus such particles can be scraped up to and be deposited upon the collector plate 60 by the rotary action heretofore described. Any suitable member, such as a suction collector tube 72, is provided to remove the solid particles deposited on the collector plate or disc. Or, if desired, the solid particles can be intermittently removed manually.

The brake disc 61 is operably carried on the collector disc 60 as by posts 70 so that the helical scraper means 40 is not appreciably compressed by the braking action. The cylinder 71 controlling the brake disc or plate 66 is of any suitable construction and has control fluid supplied thereto from a controlled source.

By the apparatus of the invention, a different type of a separator action has been obtained in that fluid flows through between the stack of discs to the outer periphery of the apparatus, and the solid particles will be withdrawn at a radially inner portion of the apparatus. The depth of the grooves, serrations or slots 46 provided in the surfaces of the discs can be varied, and even be omitted when rough surfaced discs are used, if desired, whereby gases or liquids having a low surface tension will flow between the discs in the stack of discs 30. Such discs can be formed from any suitable materials and are not very heavy. As indicated, the discs could be provided with slightly roughened or abrasive face surfaces to provide some spacing between the discs when stacked on top of each other to permit flow of fluids therethrough, but to filter off or prevent any solid particles of appreciable size from flowing therebetween. The filter action can be controlled by the surface finish on the discs. The convergence of the discs at the upper end on the stack of discs aids in the filter action. Naturally, the discs in the stack of discs can be removed for cleaning or other actions, as desired.

If desired, the outer edges of discs 30*a* can be beveled as shown at 80 in FIG. 3. Sectioning of some of the broken off annular discs 30 in FIG. 1 is omitted for clarity as are the portions of the discs on the right side of the apparatus.

The fluid-solid particle mixes being processed can be supplied to the apparatus by any suitable means, usually under low pressures and at a flow rate about equal to the rate of processing of the mix.

Hence, it is believed that novel and improved separator apparatus has been provided. It can operate continuously by supply of a mix through the tube 38. Thus, the objects of the invention have been achieved.

While one complete embodiment of the invention has been disclosed herein, it will be appreciated that modification of this particular embodiment of the invention may be resorted to without departing from the scope of the invention.

What is claimed is:

1. A centrifugal scraper and separator apparatus for fluids having solid particles therein, comprising a container having an open upper end, means mounting said container on a vertical axis for rotation thereof and adapted for connection to a drive means, an inner container having an open upper end operatively positioned within said first container for rotation therewith, a stack of annular discs in said inner container, said discs being of uniform inner and outer diameters for a major portion of the height of the stack but being of progressively smaller inner diameters approaching the upper end of the stack to form a conically shaped inner surface, said discs as stacked having fluid flow passages therethrough from their inner to their outer diameters, a vertically positioned inlet tube extending from above said container down into said inner container for feed or a fluid mix thereto, a helical scraper means supported on said inner container positioned within said stack of discs and having a cylindrical lower section and a conically shaped upper portion for scraping engagement with the inner surfaces of said discs, the convolutions of said scraper means extending upwardly, a collector plate at the upper end of said stack of discs, which plate has a center opening therein, the upper end of said scraper means extending through said opening, means to remove solids deposited on said collector plate by said scraper means, a brake member engaging the upper end of said scraper means, means to remove fluids flowing through said stack of discs, and brake means for said brake member to engage the same to slow rotation of such member and said scraper means relative to said stack of discs.

2. Apparatus as in claim 1 wherein said discs each have generally radially extending slots in at least one face thereof.

3. Apparatus as in claim 1 where said stack of discs are positioned by vertically extending ribs on the inner surface of said inner container.

4. Apparatus as in claim 1 where said scraper means is resilient in an axial direction and has its periphery in loose scraping engagement with the bores of said annular discs.

5. Apparatus as in claim 1 where said solid particles collect on the inner peripheries of said discs of said stack of discs and said scraper means moves such particles upwardly of said discs, the outer periphery of said scraper means and the inner periphery of the discs of said stack of discs being of complementary shapes.

6. A centrifugal scraper and separator apparatus for fluids having solid particles therein, comprising a container having an open upper end, driver means mounting said container on a vertical axis for rotation thereof, a stack of annular discs in said container, said discs being of uniform inner and outer diameters for a major portion of the height of the stack but being of progressively smaller inner diameters approaching the upper end of the stack to form a conically shaped inner surface, said discs outer peripheries being spaced from said container, clearance for flow of fluids being provided between the discs of said stack of discs, a vertically positioned inlet tube extending from above said container down into said container, a helical scraper means positioned within said stack of discs and having a cylindrical lower section and a conically shaped upper portion for scraping engagement with the inner surfaces of said discs, the convolutions of said scraper means extending upwardly, a centrally open collector means at the upper end of the said stack of discs, the upper end of said scraper means extending through said collector means, suction means to remove fluids flowing through said stack of discs, and brake means for said scraper means to operatively engage the same to slow rotation thereof in relation to said stack of dics.

7. Apparatus as in claim 6 where said inlet tube extends to a point adjacent the bottom of said container, and said suction means is adjacent the top of said container.

8. Apparatus as in claim 6 where said solid particles collect on the inner peripheries of said discs of said stack of discs and said scraper means moves such particles upwardly of said discs, the outer periphery of said scraper means and the inner periphery of the discs of said stack of discs being of complementary shape but having slight clearance therebetween, fluids flowing through between said discs in said stack of discs next having a vertical flow path within said container.

9. Apparatus as in claim 6 where said discs each have generally radially extending recesses in a face thereof, the recesses extending from the inner to the outer diameter thereof.

10. Apparatus as in claim 6 where said scraper means has a lower end that is slidably supported by said container.

* * * * *